US007086925B2

(12) United States Patent
Kaye et al.

(10) Patent No.: US 7,086,925 B2
(45) Date of Patent: Aug. 8, 2006

(54) CUSHIONED FASTENER

(75) Inventors: Joanne Kaye, New York, NY (US); Cataldo E Rossi, Huntersville, NC (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/782,544

(22) Filed: Feb. 19, 2004

(65) Prior Publication Data

US 2004/0221434 A1 Nov. 11, 2004

Related U.S. Application Data

(60) Provisional application No. 60/448,569, filed on Feb. 19, 2003.

(51) Int. Cl.
*A41C 3/00* (2006.01)

(52) U.S. Cl. ..... 450/58; 450/54; 2/267; 24/DIG. 43

(58) Field of Classification Search ..... 450/54–58, 450/86, 88, 36, 38, 64, 63, 71, 73, 79, 82, 450/89; 24/591.1, DIG. 43; 2/247–252, 2/267, 268, 460, 461, 462
See application file for complete search history.

(56) References Cited

U.S. PATENT DOCUMENTS

| | | | | |
|---|---|---|---|---|
| 2,180,390 | A | 11/1939 | Blair | |
| 2,593,711 | A | 4/1952 | Weatherly | |
| 2,802,215 | A * | 8/1957 | Alfandre | 112/407 |
| 2,861,276 | A * | 11/1958 | Alfandre | 112/407 |
| 3,779,250 | A | 12/1973 | Radomski | |
| 4,314,569 | A | 2/1982 | Speno | |
| 4,325,378 | A | 4/1982 | Wilkinson | |
| 5,098,331 | A | 3/1992 | Corrado | |
| 5,152,741 | A | 10/1992 | Farnio | |
| 5,157,789 | A * | 10/1992 | Klass | 2/114 |
| 5,395,280 | A * | 3/1995 | Greenberg | 450/54 |
| 6,099,382 | A | 8/2000 | Wilson | |
| 6,135,975 | A | 10/2000 | Johnstone | |
| 6,231,423 | B1 * | 5/2001 | Deal et al. | 450/57 |
| 6,253,424 | B1 | 7/2001 | Rainville-Lonn | |
| 6,309,489 | B1 | 10/2001 | Fildan et al. | |
| 6,321,388 | B1 | 11/2001 | Hildebrandt | |
| 6,439,958 | B1 * | 8/2002 | Lorenzo | 450/1 |
| 6,443,804 | B1 | 9/2002 | Grunwald | |
| 6,464,717 | B1 | 10/2002 | Smith et al. | |
| 6,513,209 | B1 | 2/2003 | Portzline | |
| 6,634,923 | B1 * | 10/2003 | Waitz | 450/86 |
| 2002/0068506 | A1 | 6/2002 | Devita et al. | |

* cited by examiner

*Primary Examiner*—Gloria M. Hale
(74) *Attorney, Agent, or Firm*—Ohlandt, Greeley, Ruggiero & Perle, L.L.P.

(57) ABSTRACT

A brassiere fastener system having a cushion structure is provided. Preferably, the cushion structure is a pouch with at least one cushion insert therein.

38 Claims, 4 Drawing Sheets

CUSHIONED FASTENER

RELATED APPLICATION

This application claims the benefit of U.S. Provisional Patent Application Ser. No. 60/448,569, filed on Feb. 19, 2003, the contents of which are incorporated by reference herein.

BACKGROUND OF THE INVENTION

1. Field of the Invention

The present invention relates generally to a fastening system for articles of apparel. More particularly, the present invention relates to a brassiere fastener or fastening system having improved cushioning.

2. Description of the Related Art

Brassieres commonly have a front panel with a pair of breast cups, a pair of side portions or panels connected, at one end, to the front panel and extending about the torso of the wearer, and having an opposite, free end with a fastening system for securing the free ends together. The brassiere, although functional, may be uncomfortable to the wearer, especially when worn for an extended period of time. A contributing factor to any discomfort is that hooks of the fastening system cause discomfort, such as scratching and irritation, to the back of the wearer.

Hook and eye type fastening systems are commonly used with a brassiere. Such fastening systems generally have a hook portion connected to the free end of one side portion and an eye portion connected to the free end of the other side portion. Both free ends are generally planar. The hook and eye portions are removably attachable to each other to secure the brassiere about the torso of the wearer. The wearer may then feel the hook, and thus scratching and/or irritation either directly or through the brassiere fabric.

Therefore, a need exists to prevent the discomfort normally caused by conventional fastening systems on the back or the front of the wearer.

SUMMARY OF THE INVENTION

It is an object of the present invention to provide a brassiere with increased comfort to the wearer.

It is also an object of the present invention to provide a brassiere with an improved fastener or fastening system.

It is a further object of the present invention to provide a fastener system having a cushion or cushioning structure.

It is still a further object of the present invention to provide a fastener system having a fabric pouch for containing a cushion or cushioning medium.

It is yet another object of the present invention to provide a cushioning structure that has a cushion material for increasing comfort to the wearer.

These and other objects and advantages of the present invention are provided by a brassiere fastener system having a first portion, a second portion adapted to mate with the first portion, and an insert connected to one of the first and second portions.

BRIEF DESCRIPTION OF THE DRAWINGS

The foregoing will be more apparent from the following detailed explanation of the preferred embodiments of the invention in connection with the accompanying drawings.

DETAILED DESCRIPTION OF THE INVENTION

Figure 1:
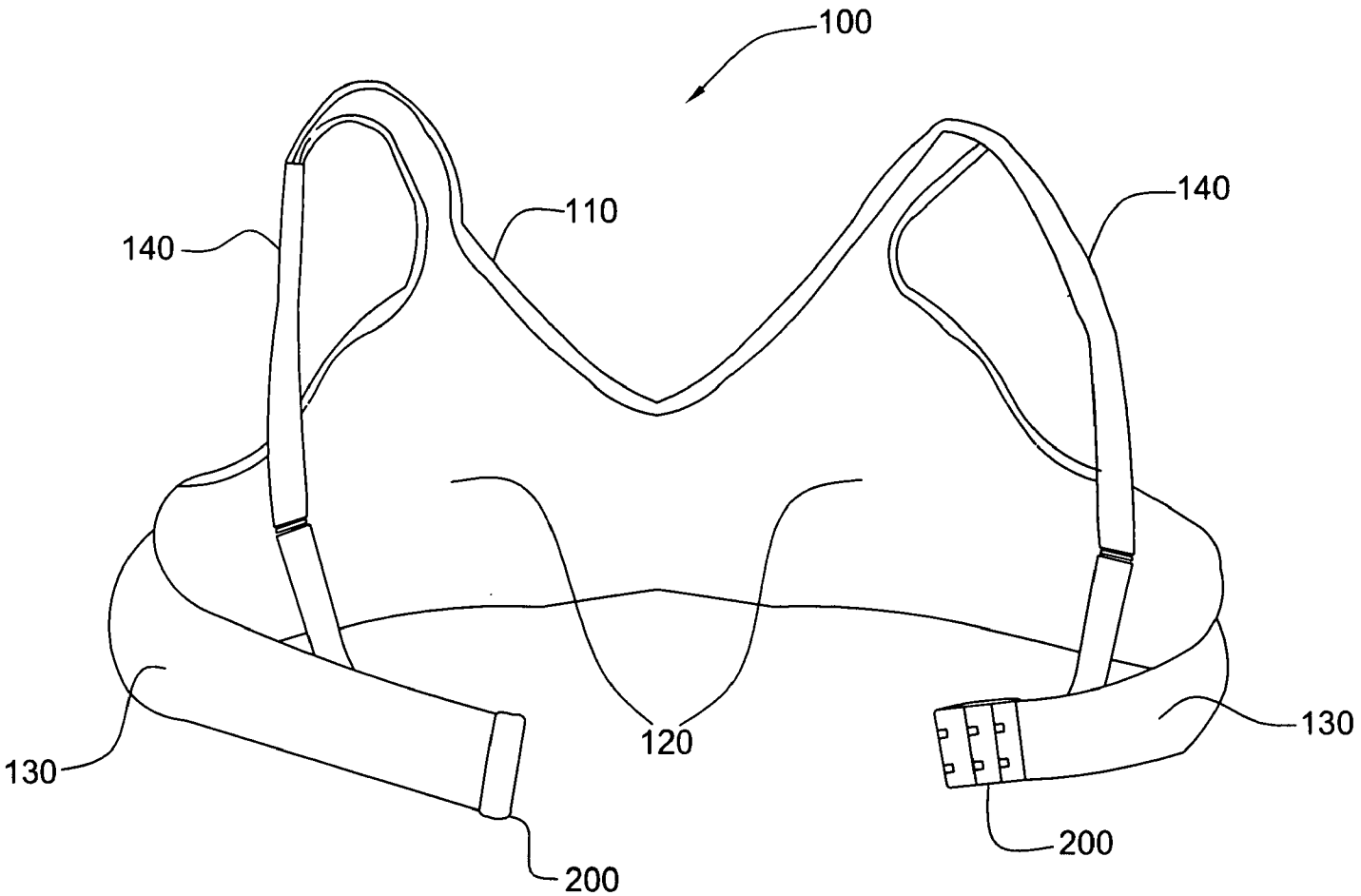
FIG. 1 illustrates a perspective view of the brassiere with the fastener system of the present invention.

Referring to the drawings and, in particular, to FIG. 1, there is illustrated a brassiere generally represented by reference numeral 100. The brassiere 100 has a front panel 110 with a pair of breast cups 120, a pair of side panels or portions 130 adapted to extend about the torso of the wearer with each side portion connected to the front panel at one end and having an opposite, free end, and a fastener system 200. The fastener system 200 is a two-piece structure with a different piece on each free end of each side panel 130 for securing the free ends of the side panels together. In a preferred embodiment, brassiere 100 has a pair of shoulder straps 140, each connected to an upper portion of front panel 110 and one of the pair of side panels 130.

Fastener system 200 is described in this application in the context of an item of intimate apparel. However, it is conceivable that fastener system 200 can be used for any garment or article of apparel.

Figure 2:
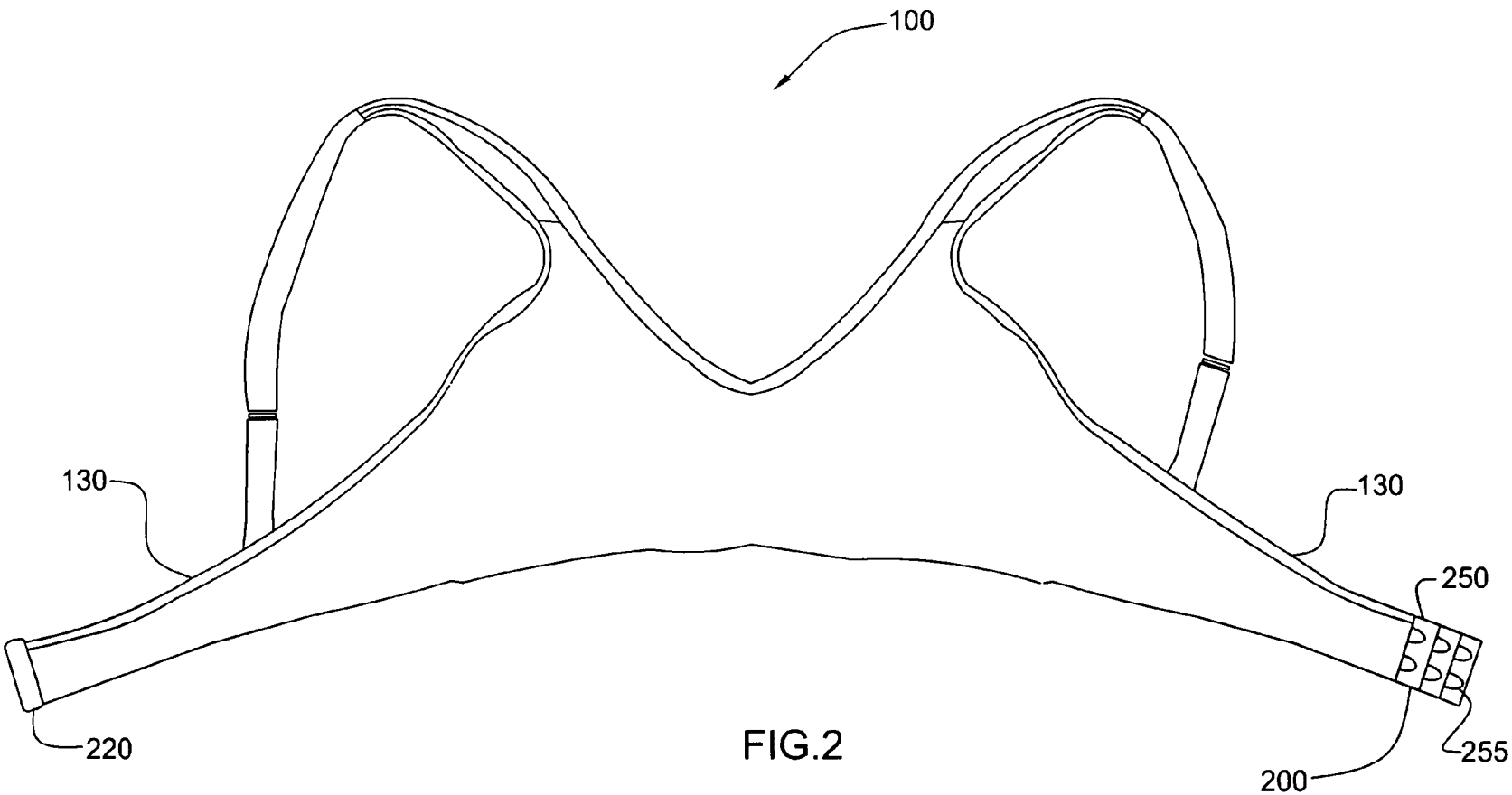
FIG. 2 is a rear view of the brassiere of FIG. 1.
Figure 3:
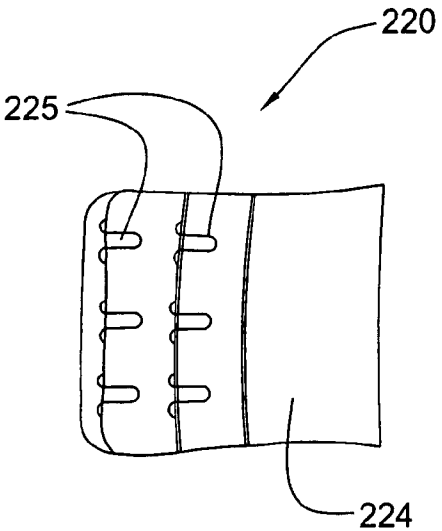
FIG. 3 is a front view of the hook component of the fastener system of FIG. 1.

Referring to FIGS. 2 and 3, fastener system 200 has a first portion or hook component 220 positioned at the free end of one side panel 130, and a second portion or loop or eye component 250 positioned at the free end of the other side panel. The hook component 220 and eye component 250 each have a fabric body. The hook component 220 has a fabric or plastic body with a first surface 224 on which one or more, preferably rows, of hooks 225 are positioned thereon. The eye component 250 has one or more loops or eyes 255. Preferably, the loops or eyes 255 are in two or more rows. Most preferably, loops 255 are in three rows of three loops. The rows of loops 255 are adapted to receive one or more rows of hooks 225 of hook component 220 to secure together the free ends of side portions 130 and, thus, secure the brassiere 100 on the body of a wearer.

Preferably, hooks 225 and loops 255 are preferably made of wound wire, plastic or other material. However, the fastener components of fastener system 200 may be any other device for connecting side portions 130 together, including but not limited to snaps, hook and loop fasteners, such as Velcro®, or buttons.

Figure 4:
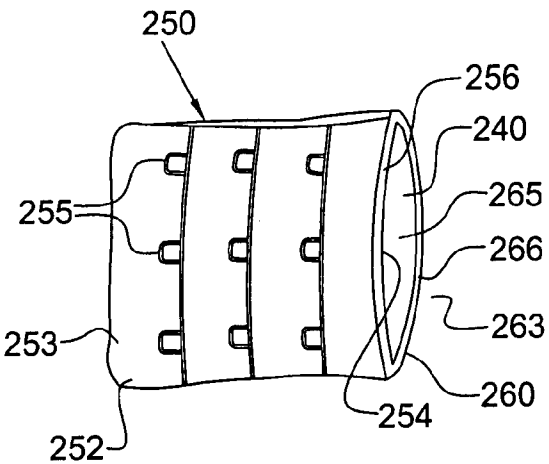
FIG. 4 is a perspective view of the pouch of the fastener system of FIG. 1, but with the cushion insert removed.

Referring to FIG. 4, eye component 250 has a first layer 252, and a second layer 260. The first layer 252 has a first or outer surface 253, a second or inner surface 254, and a free edge 256. Likewise, second layer 260 has a first or outer surface 263, a second or inner surface 265, and a free edge 266. The outer surface 263 of second layer 260 contacts the back of a wearer when brassiere 100 is on the body of the wearer. The outer surface 253 of first layer 252 has loops or eyes 225 thereon that can mate with hooks 225 of hook component 220. The inner surface 254 of first layer 252 and inner surface 265 of second layer 260 are initially connected along three perimeter edges thereof to form a pouch 240. The free edges 256, 266 are initially open, but subsequently can be closed as discussed below.

Figure 5:
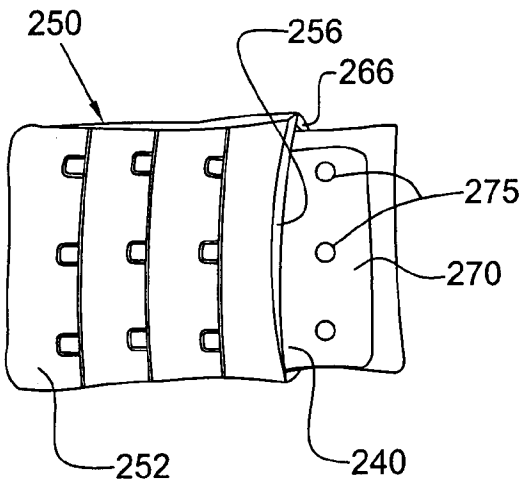
FIG. 5 is a perspective view of the pouch of the fastener system of FIG. 1, but with the cushion insert partially removed.

Referring to FIG. 5, pouch 240 receives therein a cushion insert 270. Once the cushion insert 270 is fully positioned in pouch 240, free edge 256 of first layer 252 and free edge 266 of the second layer are, preferably, secured together, preferably at the same time that loop component 250 is secured to side panel 130. In a preferred embodiment, free edges 256, 266 are sewn together and are sewn simultaneously to side portion 130. In this embodiment, virtually the entire extent of outer surface 263 of second layer 260 (shown in FIG. 2) extends from side panel 130 and, thus, contacts the back of a wearer when brassiere 100 is on the body of the wearer.

Preferably, securing together free edges 256,266, and the securement of first and second layers 252,260 to one side portion 130 is by sewing. However, any other means or way of securement or attachment may be used, including but not limited to, gluing, hook and loop fasteners, such as VELCRO®, snaps, buttons, or heat sealing.

Alternatively, pouch 240 may hold two or more cushion inserts 270.

The first layer 252 is made of conventional fabric materials. Such fabric materials can be mono-filament and/or multi filaments. Such fabric materials include, but are not limited to, polyester, microfiber, cotton, nylon, spandex such as Lycra®, power mesh, or any combinations thereof. Preferably, the material of the first layer 252 is microfiber spandex.

The second layer 260 is made of a soft material, that is preferably, more stretchable than the material of first layer 252. The material of second layer 260 is mono-filament and/or multi filaments and can be made of any material including, but not limited to, polyester, microfiber, cotton, nylon, spandex such as Lycra®, power mesh, or any combinations thereof. Preferably, the material of the second layer 260 is microfiber spandex.

Figure 7:
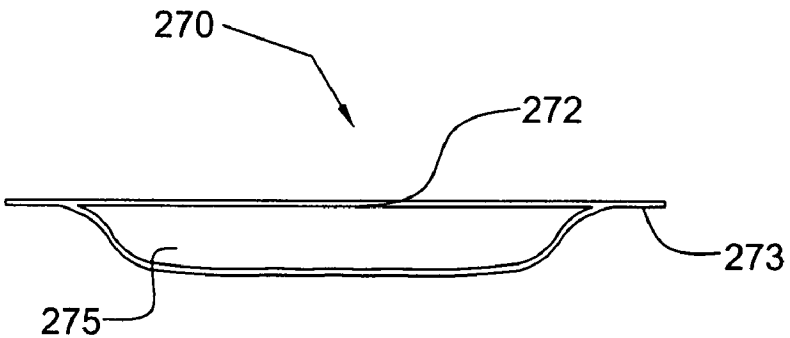
FIG. 7 is a side view of the insert of FIG. 6.
Figure 6:
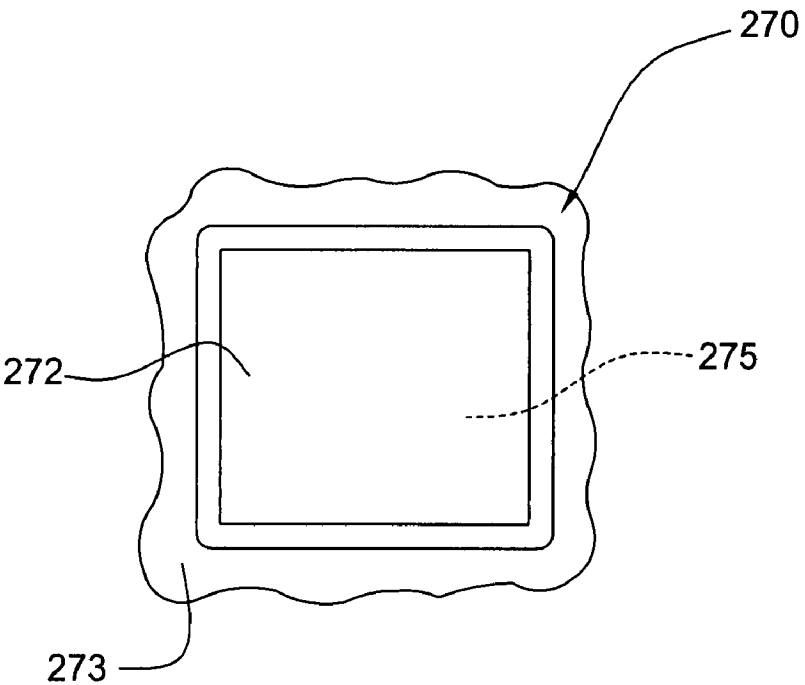
FIG. 6 is a top, planar view of a preferred insert for the fastener system of FIG. 1.

Referring to FIGS. 6 and 7, cushion insert 270 has therein a cushion or cushioning material 275. The cushion insert 270 is preferably a thin sheet of film 272 that encloses cushion or cushioning material 275. The cushion material 275 may be, but is not limited to, gel, silicone, foam, cotton batting, fiberfill, water, fabric or any other material that functions to provide a cushion feel to the wearer. Preferably, cushion material is a silicone gel.

FIGS. 6 and 7 show the preferred embodiment in which the cushion material is a silicone gel. In this embodiment, film 272 is relatively tightly secured about the silicone gel. The film 272 preferably has an enlarged film lip or border 273 that simply facilitates the manufacturing of cushion insert 270.

Referring to FIG. 5, cushion insert 270 fits snuggly into pouch 240. Preferably, an outer surface of cushion insert 270 has one or more dots of glue 275 or other adhesive-type material to tack the cushion insert into pouch 256 to prevent the cushion insert from shifting in the pouch during use of brassiere 100.

In an alternative embodiment, pouch 240 may be secured by sewing or any other known way to side panel 130, such that one of its four sides can be reopened to allow for the removal and replacement of cushion insert 270.

While brassiere 100 has been shown as a rear opening brassiere, the brassiere can be a front opening brassiere. In a front opening brassiere, fastener system 200 would simply be located between breast cups 120, and side portions 130 would be formed as a single side and back portion.

The present invention also provides that hook component 220 can have a pouch or two layer structure, analogous to that of loop component 250 discussed above. Further, similar to the alternative embodiment of loop component 250, hook component 220 can have a replaceable, instead of a fixed, cushion insert or cushion material. Thus, both the hook component 220 and loop component 250 can have the pouch construction of the present invention.

Thus, fastener system 200 has a first or hook component 220 with one or more hooks, and a second or loop component 250 with one or more loops, which loop component can be secured to the hook component. The loop component 250 has a pouch to provide a cushion structure. The cushion structure includes the pouch 240 with a cushion insert 270. The cushion insert 270 has an outer sheet of film 272 with a cushion material therein. The cushion material can be gel, silicone, foam, cotton batting, fiber fill, water fabric or any combinations thereof. Preferably, the cushion material is silicone gel. The film 272 of cushion insert 270 is preferably tacked into the pouch to avoid movement of the cushion insert 270 in the pouch. This fastener system still provides for proper alignment of the hooks and loops or eyes, yet the fastener system has a soft, comfortable feel, that can even be directly against the back of the wearer, thereby avoiding the scratching or irritation of conventional fastener systems.

Articles of apparel incorporating the fastener system allow such an article to be worn for extended periods of time with comfort. The flexibility of film 272 together with cushion material 275 allows fastener system 200 to conform to the body. By conforming to the body, the fastener system eliminates irritation and chafing that occur during different activities and extended periods of time. Further, the cushion material 275 dissipates the force of the hook and eye type fastening systems against the body of the wearer, thereby reducing pressure and enhancing comfort.

It should also be noted that the terms "first", "second", "third", "inner", "outer", and the like may be used herein to modify various elements. These modifiers do not imply a spatial, sequential, or hierarchical order to the modified elements unless specifically stated.

The present invention has been described with particular reference to the preferred embodiments. It should be understood that the foregoing descriptions and examples are only illustrative of the present invention. Various alternatives and modifications thereof can be devised by those skilled in the art without departing from the spirit and scope of the present invention. Accordingly, the present invention is intended to embrace all such alternatives, modifications, and variations that fall within the scope of the appended claims.

What is claimed is:

1. A cushioned fastener system for an article of apparel comprising:

a first fastener portion; and a second fastener portion adapted to interconnect with said first fastener portion to secure the article of apparel to a wearer;

wherein one of said first fastener portion and said second fastener portion is a cushion structure having at least one insert; said cushion structure having a first body-contacting layer and a second layer; said first layer being more stretchable than said second layer, said insert being disposed between said first body contacting layer and said second layer.

2. The cushioned fastener system according to claim 1, wherein said first fastener portion and said second fastener portion are each secured to a different one of a pair of side panels of a brassiere.

3. The cushioned fastener system according to claim 2, wherein said cushion structure is fixedly secured to said one of said pair of side panels.

4. The cushioned fastener system according to claim 2, wherein said cushion structure is releasably secured to said one of said pair of side panels.

5. The cushioned fastener system according to claim 1, wherein said cushion structure is a pouch.

6. The cushioned fastener system according to claim 1, wherein said first layer is selected from the group consisting of mono-filament material, multi-filament material, and any combinations thereof.

7. The cushioned fastener system according to claim 6, wherein said first layer comprises a material selected from the group consisting of polyester, microfiber, cotton, nylon, spandex, power mesh, and any combinations thereof.

8. The cushioned fastener system according to claim 1, wherein said second layer is selected from the group consisting of mono-filament material, multi-filament material and any combinations thereof.

9. The cushioned fastener system according to claim 8, wherein said second layer comprises a material selected from the group consisting of polyester, microfiber, cotton nylon, spandex, power mesh and any combinations thereof.

10. The cushioned fastener system according to claim 1 wherein said first layer is microfiber spandex.

11. The cushioned fastener system according to claim 1, wherein said second layer is microfiber spandex.

12. The cushioned fastener system according to claim 1, wherein said first layer has a first free-end and said second layer has a second free-end.

13. The cushioned fastener system according to claim 12, wherein said first free-end and said second free-end are mutually connectable.

14. The cushioned fastener system according to claim 12, wherein said first and second free-ends are fixedly connected.

15. The cushioned fastener system according to claim 12, wherein said first and said second free-ends are releasably connected.

16. The cushioned fastener system according to claim 5, wherein said insert is adhesively connected to said pouch.

17. The cushioned fastener system according to claim 1, wherein said insert comprises a film that encases a cushioning substance.

18. The cushioned fastener system according to claim 17, wherein said film further comprises a border therearound.

19. The cushioned fastener system according to claim 17, wherein said cushioning substance is selected from the groups consisting of gel, foam, cotton batting, fiber fill, water, silicone, and any combinations thereof.

20. The cushioned fastener system according to claim 17, wherein said cushioning substance is silicone gel.

21. The cushioned fastener system according to claim 5, wherein said at least one insert is removably connected to said pouch.

22. The cushioned fastener system according to claim 1, wherein said cushion structure has two inserts.

23. A cushioned fastener system for an article of apparel comprising:

a first fastener portion; and a second fastener portion adapted to interconnect with said first fastener portion to secure the article of apparel to a wearer, wherein one of said first fastener portion and said second fastener portion is a pouch, adapted to contact a body, containing a cushion insert capable of reducing pressure against the body and enhancing conformability to the body, said insert being disposed inside of said pouch.

24. The cushioned fastener system according to claim 23, wherein said pouch comprises a first layer having a first free-end and a second layer having a second free-end.

25. The cushioned fastener system according to claim 24, wherein said free-ends are mutually connectable.

26. The cushioned fastener system according to claim 24, wherein said free-ends are releasably connected.

27. The cushioned fastener system according to claim 24, wherein said free-ends are fixedly connected.

28. The cushioned fastener system according to claim 23, wherein said insert comprises a film that encases a cushioning substance.

29. The cushioned fastener system according to claim 28, wherein said film further has a border therearound.

30. The cushioned fastener system according to claim 28, wherein said cushioning substance is selected from the group consisting of gel, foam, cotton batting, fiber fill, water, silicone and any combinations thereof.

31. The cushioned fastener system according to claim 28, wherein said cushioning substance is silicone gel.

32. The cushioned fastener system according to claim 23, wherein said pouch is fixedly secured to said article of apparel.

33. The cushioned fastener system according to claim 23, wherein said pouch is removably secured to said article of apparel.

34. The cushioned fastener system according to claim 23, wherein said insert is adhesively connected to said pouch.

35. The cushioned fastener system according to claim 23, wherein said insert is removably connected to said pouch.

36. The cushioned fastener system according to claim 23, wherein said cushion structure has two inserts.

37. The cushioned fastener system according to claim 23, wherein said article of apparel is an undergarment.

38. The cushioned fastener system according to claim 23, wherein said article of apparel is a brassiere.

* * * * *